United States Patent [19]

Secon

[11] 4,391,378

[45] Jul. 5, 1983

[54] SHELVING CONSOLE FURNITURE

[75] Inventor: Edward Secon, Trumbull, Conn.

[73] Assignee: The Sherwood Corporation, Spring City, Tenn.

[21] Appl. No.: 310,218

[22] Filed: Oct. 9, 1981

[51] Int. Cl.[3] ..... A47F 5/01

[52] U.S. Cl. ..... 211/187; 108/91; 108/109; 211/188; 211/181

[58] Field of Search ..... 211/186, 187, 181, 188, 211/194, 208; 108/111, 91, 109

[56] References Cited

U.S. PATENT DOCUMENTS

| | | | |
|---|---|---|---|
| 2,933,193 | 4/1960 | De Mattia | 211/187 X |
| 3,101,148 | 8/1963 | Brown | 211/181 X |
| 4,169,639 | 10/1979 | Zola | 108/111X |
| 4,226,190 | 10/1980 | Ashton | 108/91 |

*Primary Examiner*—Ramon S. Britts
*Assistant Examiner*—Robert W. Gibson, Jr.
*Attorney, Agent, or Firm*—Alan Ruderman

[57] ABSTRACT

Multi-shelf console furniture constructed having a pair of side frame support standards each being formed from a pair of laterally spaced wire frame members interconnected by a multiplicity of equally spaced U-shaped rungs, and shelving members of various configurations each having a rectangular frame with a rung connecting hook at each corner. The U-shaped rungs have the cross-piece of the "U" facing into the interior of the frame members and the hooks are positionable within the space defined by the U-shaped members and have a portion which rests on a leg of the member. Vertical stacking of the standard, and thus vertically built-up units, may be provided utilizing a ring coupling having a pair of spaced rectangular frames which grasp respective rungs of the upper and lower standards. Braces having rung gripping hooks may be utilized to increase the rigidity of the furniture units.

8 Claims, 3 Drawing Figures

SHELVING CONSOLE FURNITURE

BACKGROUND OF THE INVENTION

This invention relates to knock-down readily assembled furniture and more particularly shelving consoles of this type that may be readily stacked horizontally and vertically and combined with the various interchangeable accessory members for providing a variety of shelf type furniture consoles and cabinetry.

Furniture generally has been constructed having a basic fixed configuration with no provision for expansion or modification from the initial form of the unit. In many situation purchasers of such furniture may have a particular need which need, due to various changing circumstances, may change in time with the result that the unit is discarded. In other cases the need may evolve for additional pieces to be used together with the originally obtained item. Under such circumstances it is not unusual to find that the additional units are aestetically incompatible. However, even if the styles are compatible, the furniture units have no provision for use directly together as by stacking such units either horizontally or vertically or both. The only known furniture items having features of this general nature are the wall shelving units having wall mounted bracket carrying standards, which have the obvious disadvantages of being confined to wall surfaces.

SUMMARY OF THE INVENTION

Consequently, it is a primary object of the present invention to provide a unit of furniture having a simplified construction which may be readily assembled and expanded by horizontal and vertical stacking.

It is another object of the invention to provide a construction for shelf-type furniture which permits flexibility and variation in functionality so that a large number of furniture items may be obtained through selective assembly of various elements.

It is a further object of the present invention to provide a construction for shelf-type furniture having side frame support standards adapted for receiving various shelving and cabinetry members, and structural bracing and coupling members for forming selected variations of furniture units.

In accordance with the invention there is provided a side frame support standard which together with one or more similar standards and shelving members can be formed into multi-shelf furniture units. Each side frame support standard comprises a pair of laterally spaced frame members interconnected by a multiplicity of equally spaced cross piece rungs having a substantially U-shaped configuration facing inwardly toward the interior of the structure and adapted for receiving and supporting hook connectors on the various shelving members. Each pair of side frame support standards may be further tied rigidly together by braces having rung grasping hooks. Vertical stacking is provided by interconnecting superposed side frame support standards with ring-type coupling members grasping respective rungs of the upper and lower standards. With this construction enclosed cabinets, drawers and other functional members may be readily installed on a basic shelf unit as can various accessory members to provide great flexibility in the choice of utilitarian function of the furniture.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

Figure 3:
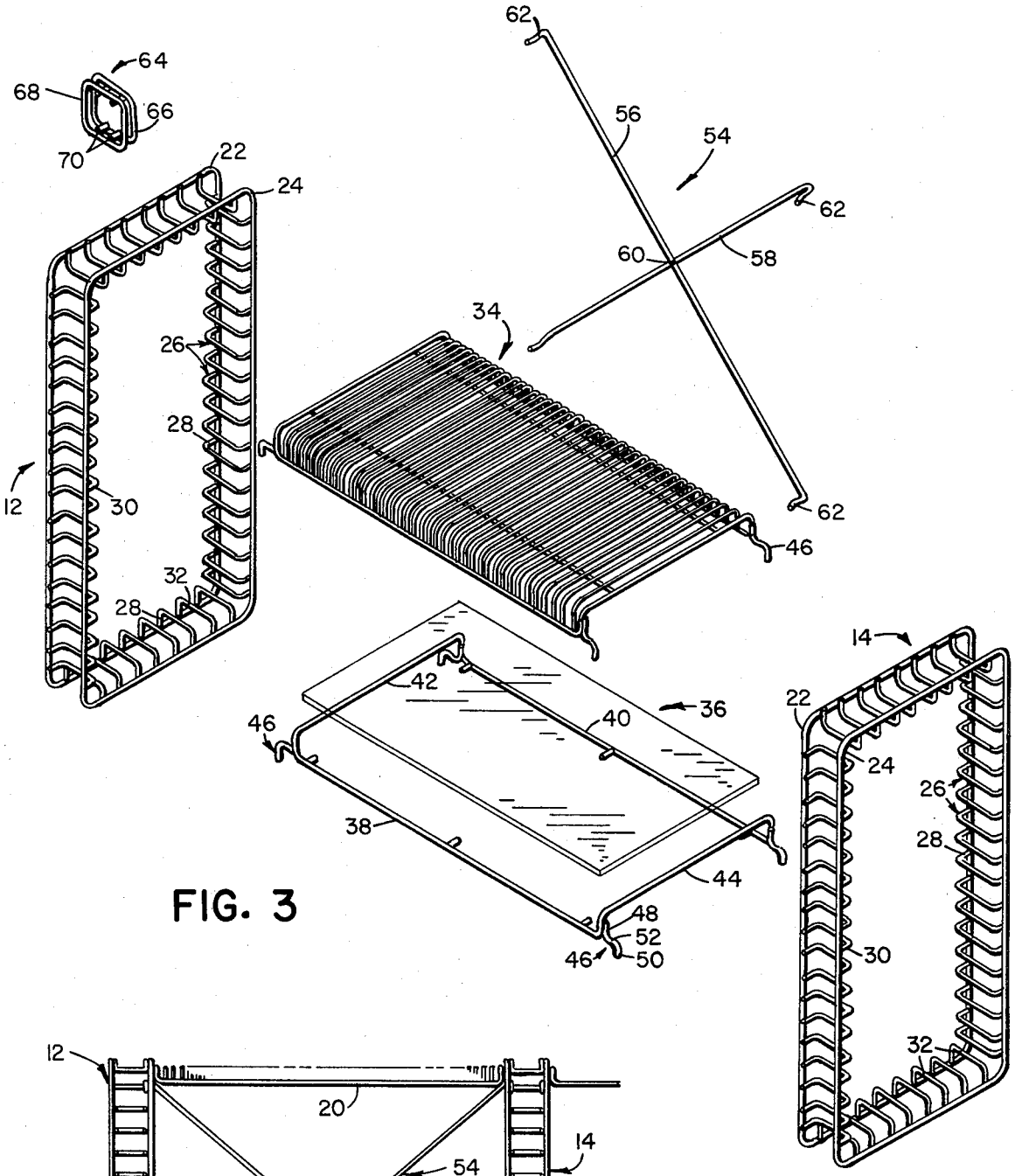
FIG. 3 is a disassembled perspective view of the basic unit including the ring coupling for vertical stacking of the units.
Figure 1:
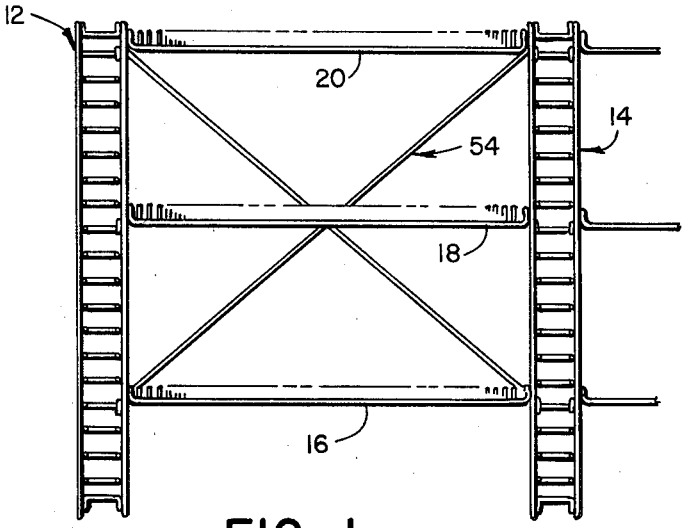
FIG. 1 is a front elevational view of a basic three shelf furniture unit constructed in accordance with the principles of the present invention and illustrating a fragment of an adjacent unit.

Referring now to FIG. 1 a basic shelving unit constructed in accordance with the present invention comprises a pair of side frame support standards 12 and 14, which is illustrated as supporting three shelves 16, 18, 20, although it will be understood that any number of shelves or shelf-type accessories may be carried by the standards as hereinafter described. Each side frame standard 12, 14, as best illustrated in FIG. 3, comprises a pair of laterally spaced wire frame members 22, 24 bent into a substantially rectangular form of any desired size preferably having the vertical legs elongated relatively to the horizontal legs. Positioned between and interconnecting the members 22, 24 are a multiplicity of substantially U-shaped connecting members 26 which appear as rungs on a ladder and also comprise wire form which is secured as by welding at the ends of the legs 28, 30 to the respective members 22, 24. The connecting members 26 are substantially equally spaced about the entire side frame support standard and have the cross leg 32 facing inwardly toward the interior of the structure, i.e. toward the interior space of the rectangular form so that the members 26 project from the frame toward each other from opposite legs of the standards.

The shelves of the unit may take on a variety of forms such as the multi-wire shelf illustrated in FIG. 3 at 34, or a glass shelf as illustrated at 36 or maybe a planar shelf member such as sheet metal, laminated plastic or the like. Moreover, accessory items such as a wine rack or record bin may be utilized rather than a surface supporting shelf in accordance with the teachings of this invention. Each shelf, of whatever form, comprises a basic frame structure having a rectangular form also preferably of wire including a pair of spaced front and rear border members 38, 40 interconnected by side border members 42, 44, which may be attached to the members 38, 40 in any convenient manner. Preferably the shelf frame comprises a single wire bent appropriately and welded at its ends. For every shelf or shelf-like member, however, the corners of the intersection of the respective adjacent border members 38, 40, 42, 44 include hook shaped connectors 46, which preferably have a pair of laterally offset legs 48, 50 interconnected by a substantially horizontal leg 52. Each leg 48 is fixed to a corner of the shelf frame so that the leg 52 extends at each end of the front and rear border members 38, 40. Thus, the legs 50 project downwardly and may be positioned within selected ones of the U-shaped rung connectors 26. In this manner the leg 52 rests and is supported by the laterally interior legs 30 of the rung connectors at the front and back of each standard to position and mount the shelf. By standardizing the size of the frame of each shelf and shelf-like member, any basic shelf-like unit may be assembled in this manner.

The rigidity of the shelf-like units can be increased by means of an X-brace 54 best illustrated in FIG. 3. The brace 54 comprises a pair of rods or legs 56 and 58 pivotally connected together intermediate their ends at 60. At the ends of each leg 56, 58 and hook 62 is formed extending out of the plane of the respective legs 56, 58. The brace may be positioned at the rear of the unit with the hooks facing forwardly. The hooks 62 of the upper end of leg 56 and the lower end of leg 58 are positioned on respective rung connectors 26 of the standard 12 and the legs are adjusted so that the hooks on the other end of each leg are positioned on respective rungs of the standard 14 and snapped in place. In this manner, the hooks frictionally engage the frame members 24 and by appropriate sizing of the legs 56, 58, provide a force pulling the standards 12 and 14 together, thereby providing an extremely rigid structure. The use of such a brace is especially desireable when a unit is composed of two or less shelf-type members such as a desk.

Figure 2:
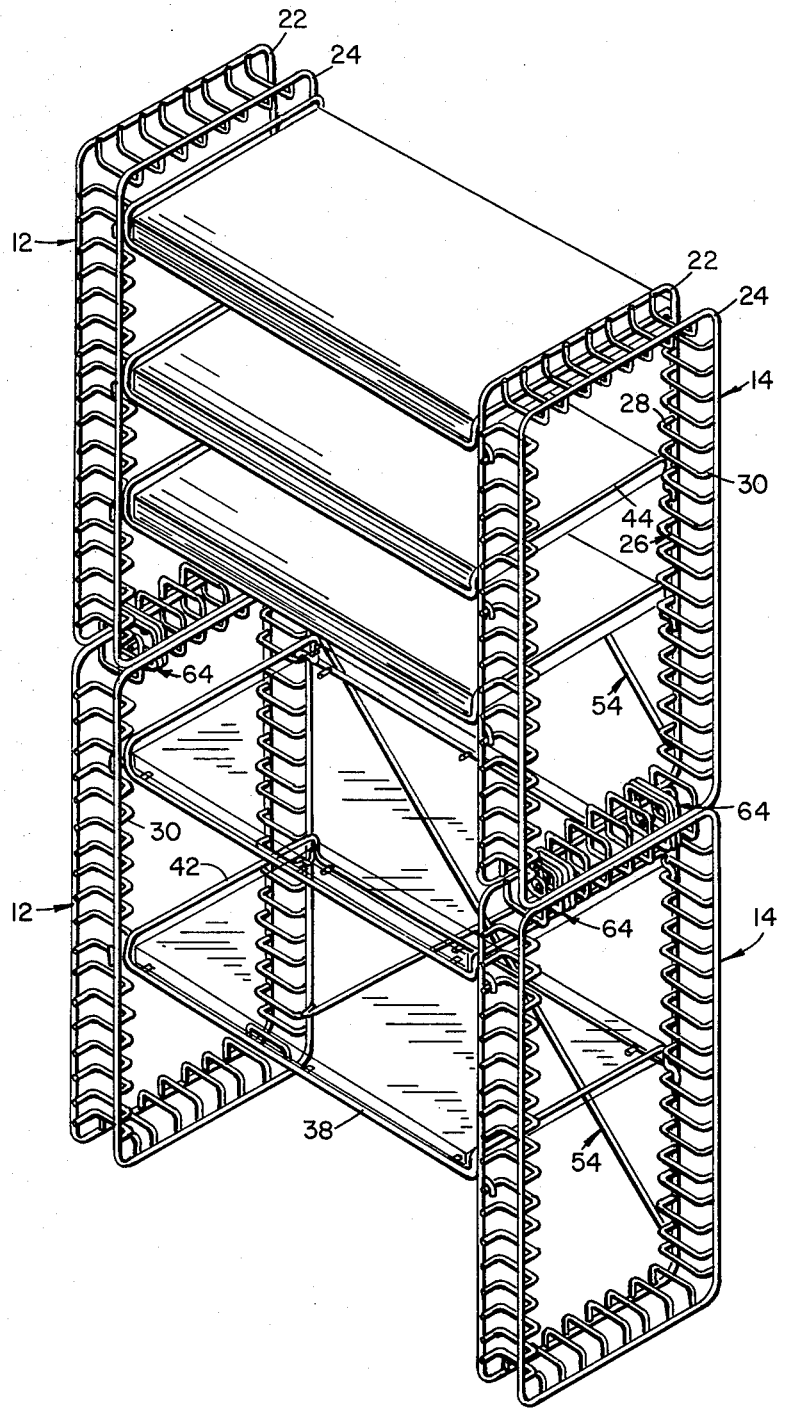
FIG. 2 is a perspective view of the basic unit illustrated in FIG. 1 depicting a vertically stacked similar unit attached thereon.

It should be understood that two or more units may be stacked horizontally merely by the addition of side frame support standards and interconnecting shelf members between each pair of adjacent standards. In order to stack units vertically, there is provided a ring-type coupling 64, best illustrated in FIG. 3. The coupling 64 comprises a pair of substantially square shaped wire frame members 66, 68, of a size substantially equal to the length of the leg 32 of the rung connectors 26, the members 66, 68 being interconnected as a unit by short rods 70 at the interior of the top and bottom, the rods spacing the members 66, 68 apart a distance substantially equal to the thickness of the leg 32. Thus, each coupling 64 may be positioned between the frames 22 and 24 about a rung 26 with the members 66, 68 grasping and sandwiching the legs of the rung therebetween, the rods 70 acting as stops and being disposed in abutment with the leg 32 of the rung. By utilizing two such couplings for each of the standards 12, 14, a similar pair of standards may be disposed on the first pair as illustrated in FIG. 2 and securely attached thereto by the coupling. Consequently, vertical, stacked units may be readily provided when desired, and any combination of shelf-type units built up and knocked-down when required. Moreover, door and panel connectors and drawer side panels can be readily attached to a unit as desired by providing such doors and panels with a grooved edge which may grasp the legs 30 of selected rungs 26.

Numerous alterations of the structure herein disclosed will suggest themselves to those skilled in the art. However, it is to be understood that the present disclosure related to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. A shelving console furniture unit comprising a pair of laterally spaced side frame support standards for supporting the ends of at least one shelf member therebetween, each standard comprising a pair of wire frame members each frame member being identical and having spaced vertical and spaced horizontal portions interconnected to define a border about an opening, a multiplicity of rungs of finite thickness secured to and between each pair of frame members at substantially equally spaced similarly disposed locations about the border and extending into said opening, said shelf member comprising a substantially rectangular frame, a hook outstanding at each corner of said shelf frame having a downwardly disposed portion, each said hook being positionable upon a rung with the downwardly disposed portion projecting between the rung and the adjacent frame members.

2. A shelving console furniture unit as recited in claim 1, wherein each rung comprises a substantially U-shaped member having a pair of legs spaced apart by an interconnecting cross-piece, said rungs being secured at the end of each leg to a respective frame member, and said cross-piece being disposed within said opening between said frame members.

3. A shelving console furniture unit as recited in claim 2, wherein said hook includes a first leg outstanding laterally from said corner and a second leg extending downwardly at the free end of the first leg, said first leg being positionable upon a leg of a selected U-shaped member with said second leg positionable within the space defined by said U-shaped member.

4. A shelving console furniture unit as recited in claim 1, including a coupling for interconnecting a pair of side frame support standards one upon the other, said coupling comprising a pair of spaced apart substantially rectangular annual frame members, a first pair of the sides of each of said rectangular members being of a length substantially equal to the spacing between said wire frame members, means for connecting a respective side of the first pair of sides of each of said rectangular members to a corresponding side of the other rectangular member to connect said rectangular members together in spaced relationship a distance substantially equal to the thickness of said rung, said means being disposed for allowing limited entry of a rung into the space between said rectangular members and for abuting said rung when said coupling is disposed about the rung, whereby said coupling may grasp a rung on the top of the bottom standard and a respective rung disposed on the bottom of the upper standard.

5. A shelving console furniture unit as recited in claim 1, including a coupling for interconnecting a pair of side frame support standards one upon the other, said coupling comprising a pair of spaced apart substantially rectangular annual frame members, a first pair of the sides of each of said rectangular members being of a length substantially equal to the spacing between said wire frame members, means for connecting said rectangular members together in spaced relationship a distance substantially equal to the thickness of said rungs for grasping a pair of rungs along each respective side of said first pair of sides.

6. A shelving console furniture unit as recited in claim 2, including a coupling for interconnecting a pair of side frame support standards one upon the other, said coupling comprising a pair of spaced apart substantially rectangular annular frame members, a first pair of the sides of each of said rectangular members being of a length substantially equal to the spacing between said wire frame members, means for connecting said rectangular members together in spaced relationship a distance substantially equal to the thickness of a cross-piece, said means being disposed within said rectangular members for limiting entry of a cross-piece a fixed distance from each side of the first pair of sides of said rectangular members into the space between said rectangular members, whereby said coupling may grasp the cross-piece of a selected rung on the top of the bottom standard and a cross-piece of a corresponding rung on the bottom of the upper standard.

7. A shelving console furniture unit as recited in claim 6, wherein said means for connecting said rectangular members together comprises at least one rod secured to the interior surfaces of each respective side of each pair of first sides of said rectangular members, each rod abuting the cross-piece of the selected rungs.

8. A shelving console furniture unit as recited in claim 1, including a brace for providing rigidity to said unit, said brace comprising a pair of rods, means for pivotably connecting said rods together intermediate their extremities, and a hook at each extremity of each rod for grasping two selective rungs of each pair of spaced standards.

* * * * *